US007418840B2

(12) United States Patent
Kim

(10) Patent No.: US 7,418,840 B2
(45) Date of Patent: Sep. 2, 2008

(54) METHOD OF CONTROLLING WASHING COURSE IN WASHING MACHINE

(75) Inventor: Kwang Soo Kim, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 618 days.

(21) Appl. No.: 10/960,957

(22) Filed: Oct. 12, 2004

(65) Prior Publication Data

US 2005/0081309 A1 Apr. 21, 2005

(30) Foreign Application Priority Data

Oct. 16, 2003 (KR) ..... 10-2003-0072106

(51) Int. Cl.
*D06F 33/02* (2006.01)
*D06F 33/04* (2006.01)
*D06F 33/06* (2006.01)

(52) U.S. Cl. ..... 68/12.02

(58) Field of Classification Search ..... 68/12.02
See application file for complete search history.

(56) References Cited

U.S. PATENT DOCUMENTS 2,540,717 A * 2/1951 Diether ..... 68/12.24
2001/0011395 A1* 8/2001 Skripper et al. ..... 8/159

FOREIGN PATENT DOCUMENTS

CN 1266921 A 9/2000

* cited by examiner

*Primary Examiner*—Michael Cleveland
*Assistant Examiner*—Samuel A Waldbaum
(74) *Attorney, Agent, or Firm*—McKenna Long & Aldridge LLP

(57) ABSTRACT

The present invention provides a method of controlling a washing course in a washing machine, by which a drive motor for rotating a drum is prevented from being overloaded according to a laundry amount and by which a drum can be smoothly rotated without unnecessary power consumption provided to a motor. In a washing machine having a motor for rotating a drum in a first direction, the present invention includes the steps of driving the motor to rotate the drum at a prescribed angle in the first direction, stopping driving the motor so that the drum is rotated by a gravitational force of a laundry within the drum in a second direction opposite to the first direction, and rotating the drum in the first direction again by driving the motor while the drum is rotated in the first direction switched from the first direction by the gravitational force of the laundry.

21 Claims, 7 Drawing Sheets

METHOD OF CONTROLLING WASHING COURSE IN WASHING MACHINE

This application claims the benefit of Korean Application No. 10-2003-0072106 filed on Oct. 16, 2003, which is hereby incorporated by reference in its entirety.

BACKGROUND OF THE INVENTION

1. Field of the Invention

The present invention relates to a method of controlling a washing course in a washing machine, by which a rotational force of a drum can be compensated in case that a laundry is excessively put in the drum to weaken the rotational force in an early stage of the washing cycle.

2. Discussion of the Related Art

Generally, a washing machine is a home appliance for removing dirt or filth attached a laundry by chemical reaction and mechanical impact. A drum type washing machine, which is a sort of the washing machine, is advantageous in increasing its washing capability as well as in lowering its overall height smaller than that of a pulsator type washing machine having an upright drum that is rotated for washing. And, the drum type washing machine prevents such a problem as laundry entanglement, laundry raveling, and the like. Hence, the demand for the drum type washing machine tends to rise.

A configuration of a general drum type washing machine is explained by referring to the attached drawing as follows.

FIG. 1 is a cross-sectional diagram of a drum type washing machine according to a related art.

Referring to FIG. 1, a drum type washing machine according to a related art consists of a tub 2 supported by a damper 7 and a spring 6 provided within a body 1, a cylindrical drum 3 installed within the tub 2 to be rotatable centering around a horizontal axis, and a motor 5 connected to the drum 3 via the horizontal axis.

The motor 5 is mounted on a rear surface of the tub 2 and consists of a rotor 5*b* and a stator 5*a*. In order to transfer a drive force of the rotor 5*b* to the drum 3 directly without using a pulley or belt, a drum shaft 4 is directly connected to the rotor 5*b* to rotate together with the drum 3.

A door 8 is provided to a prescribed location of a front surface of the body 1 to confront an opening of the drum 3. A gasket 9 is provided between the door 8 and the drum 3 to maintain a hermetic state within the drum 3. And, a control panel 10 is provided over the door 8 to control an overall operation of the washing machine according to user's operational command.

In the above-configured drum type washing machine, the drive (rotational) force of the rotor 5*b* is transferred to the drum 3 via the drum shaft 4. Hence, the drum 3 is rotated so that a laundry is lifted upward by a lifter 3*a* to fall due to gravity. Thus, a washing cycle is performed.

However, in the related art drum type washing machine, in case of putting a laundry in the drum 3 excessively, the laundry tends to closely adhere to a door glass 8*a* of the door 8 projected inward the opening. If so, the motor 5 becomes overloaded in an initial rotation of the drum 3. In a worsened case, the motor 5 is unable to rotate the drum 3. Hence, the washing cycle may stop while an upper portion of the laundry fails to be soaked in water.

SUMMARY OF THE INVENTION

Accordingly, the present invention is directed to a method of controlling a washing course in a washing machine that substantially obviates one or more of the problems due to limitations and disadvantages of the related art.

An object of the present invention, which has been devised to solve the foregoing problem, lies in providing a method of controlling a washing course in a washing machine, by which a drive motor for rotating a drum is prevented from being overloaded according to a laundry amount.

It is another object of the present invention to provide a method of controlling a washing course in a washing machine, by which a drum can be smoothly rotated without unnecessary power consumption provided to a motor.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, in a washing machine having a motor for rotating a drum in a first direction, there is provided a method of controlling a washing course including an initial drive sub-routine for the motor.

The sub-routine includes the steps of driving the motor to rotate the drum at a prescribed angle in the first direction, stopping driving the motor so that the drum is rotated by a gravitational force of a laundry within the drum in a second direction opposite to the first direction, and rotating the drum in the first direction again by driving the motor while the drum is rotated in the first direction switched from the first direction by the gravitational force of the laundry.

Preferably, the first step can be replaced by the following steps. First of all, a control unit of the washing machine drives the motor until the drum is unable to be further rotated. The control unit then stops driving the motor for the second-directional rotation of the drum by the gravitational force of the laundry.

Preferably, the method further includes the steps of measuring a laundry amount of the laundry put in the drum and executing the sub-routine if the measured laundry amount is equal to or greater than a prescribed laundry amount.

Preferably, the method further includes the steps of driving the motor to rotate the drum at a prescribed angle in the first direction, stopping driving the motor when the drum is rotated at an angle smaller than a first angle, re-driving the motor after an elapse of a prescribed time and counting a re-driving number of the motor, if the counted re-driving number is equal to or greater than a prescribed number, executing the sub-routine.

In another aspect of the present invention, there is provided a washing machine including a tub, a drum installed within the tub to be rotated centering around a horizontal axis, a motor rotating the drum in a first direction, an inlet/outlet unit supplying/draining water to/from the tub, and a control unit controlling an operation of the inlet/outlet unit, the control unit executing an initial operation sub-routine for the motor if deciding that a laundry amount of a laundry within the drum exceeds a prescribed laundry amount, the initial operation sub-routine for the motor including the steps of driving the motor to rotate the drum at a first angle in the first direction, stopping driving the motor so that the drum is rotated in a second direction opposite to the first direction by a gravitational force of the laundry within the drum, and driving the motor again to rotate the drum in the first direction while the drum is rotated again in the first direction switched from the second direction by the gravitational force of the laundry.

In another aspect of the present invention, there is provided a washing machine including a tub, a drum installed within the tub to be rotated centering around a horizontal axis, a motor rotating the drum in a first direction, an inlet/outlet unit supplying/draining water to/from the tub, and a control unit controlling an operation of the inlet/outlet unit, the control unit executing an initial operation sub-routine for the motor if deciding that a laundry amount of a laundry within the drum exceeds a prescribed laundry amount, the initial operation sub-routine for the motor including the steps of driving the motor to rotate the drum angle in the first direction until the drum is unable to be further rotated, stopping driving the motor so that the drum is rotated by a gravitational force of a laundry within the drum in a second direction opposite to the first direction, and rotating the drum in the first direction again by driving the motor while the drum is rotated in the first direction switched from the first direction by the gravitational force of the laundry.

In another aspect of the present invention, in a washing machine having a motor for rotating a drum, there is provided a method of controlling a washing course including a first step of driving the motor until the drum is unable to further be rotated in a first direction, a second step of driving the motor in a second direction opposite to the first direction to rotate the drum in the second direction using a gravitational force of a laundry within the drum and a drive force of the motor until the drum fails to be further rotated in the second direction, and a third step of repeating the first and second steps until the drum is rotated in the first direction at an angle equal to or greater than a prescribed angle.

In a further aspect of the present invention, there is provided a washing machine including a tub, a drum installed within the tub to be rotated centering around a horizontal axis, a motor rotating the drum in a first direction, an inlet/outlet unit supplying/draining water to/from the tub, and a control unit controlling an operation of the inlet/outlet unit, the control unit executing an initial operation sub-routine for the motor if deciding that a laundry amount of a laundry within the drum exceeds a prescribed laundry amount, the initial operation sub-routine for the motor including a first step of driving the motor until the drum is unable to further be rotated in a first direction, a second step of driving the motor in a second direction opposite to the first direction to rotate the drum in the second direction using a gravitational force of a laundry within the drum and a drive force of the motor until the drum fails to be further rotated in the second direction, and a third step of repeating the first and second steps until the drum is rotated in the first direction at an angle equal to or greater than a prescribed angle.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

First of all, a method of controlling a washing cycle in a drum type washing machine according to embodiments of the present invention is explained by referring to FIGS. 2 to 5 as follows.

Figure 2A:
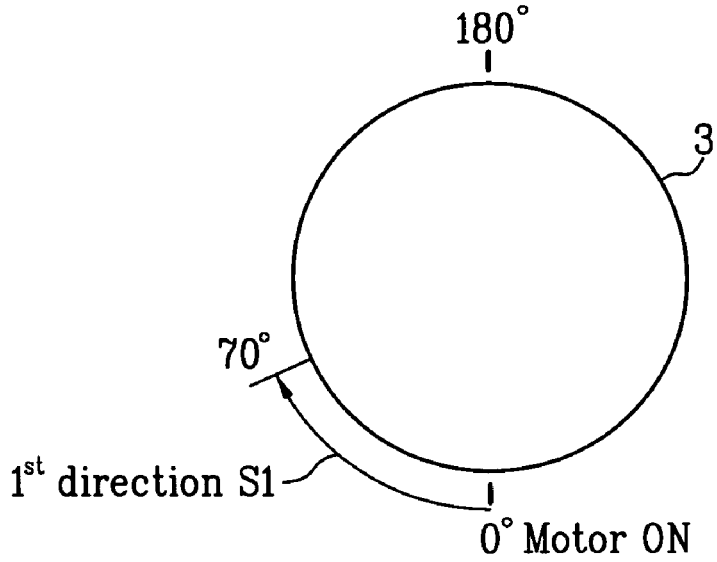
FIGS. 2A to 2C are diagrams for explaining a principle of a method of controlling a washing cycle in a washing machine according to the present invention.
Figure 2B:
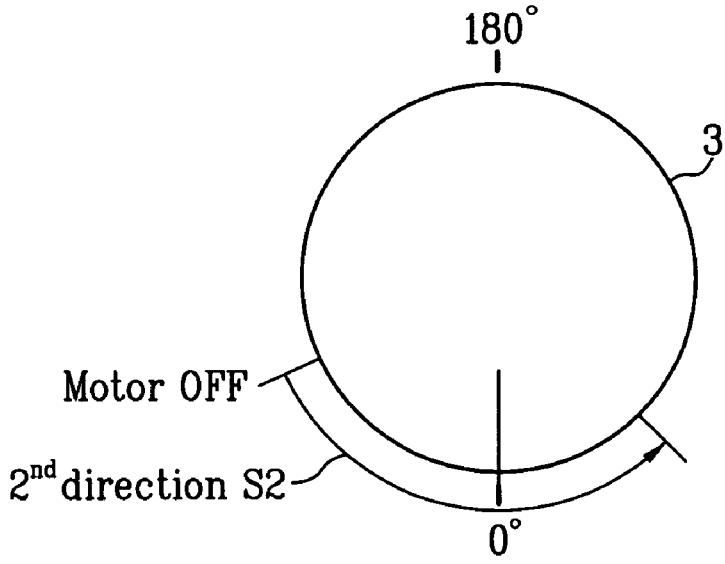
Figure 2C:
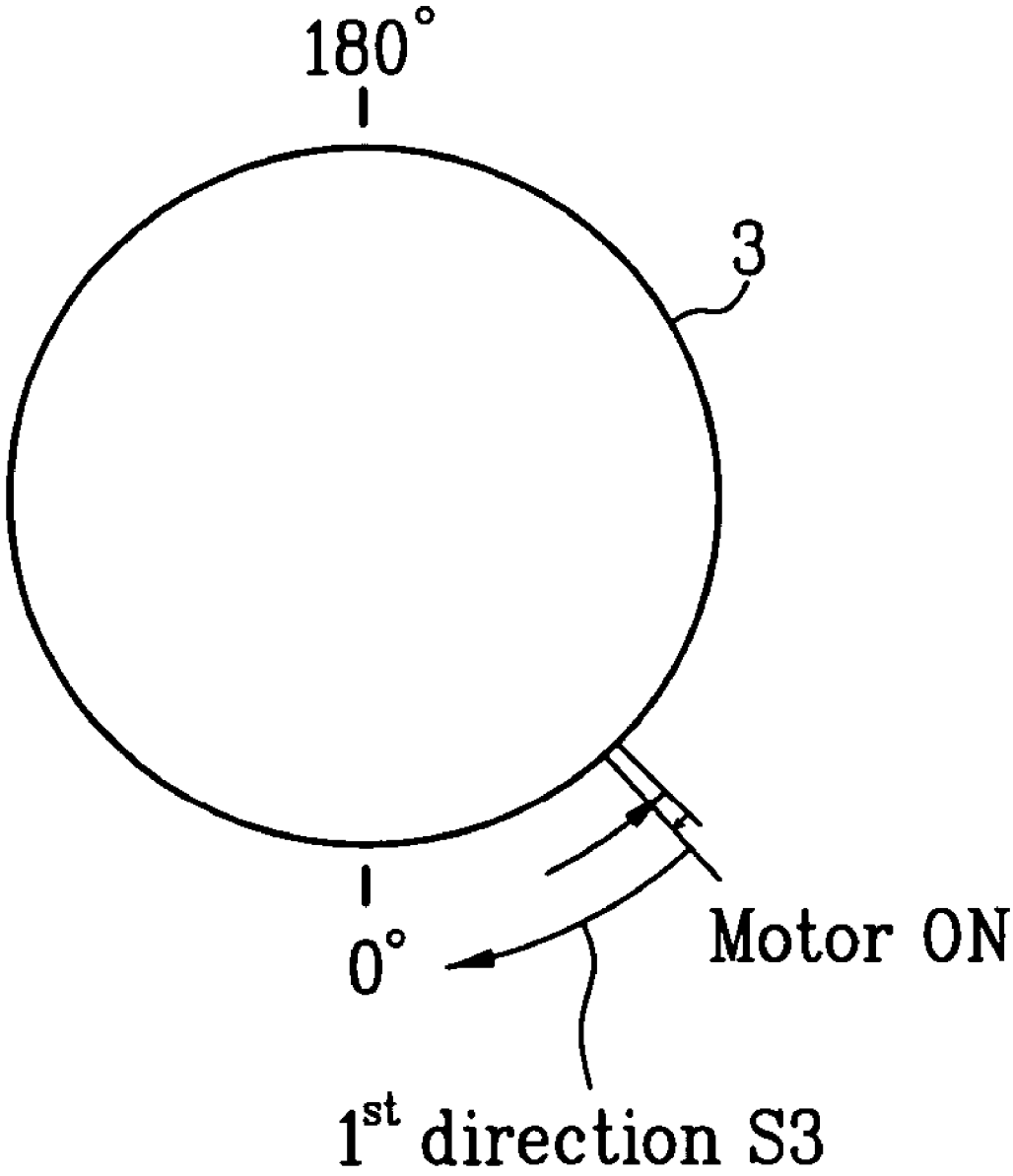
Figure 3:
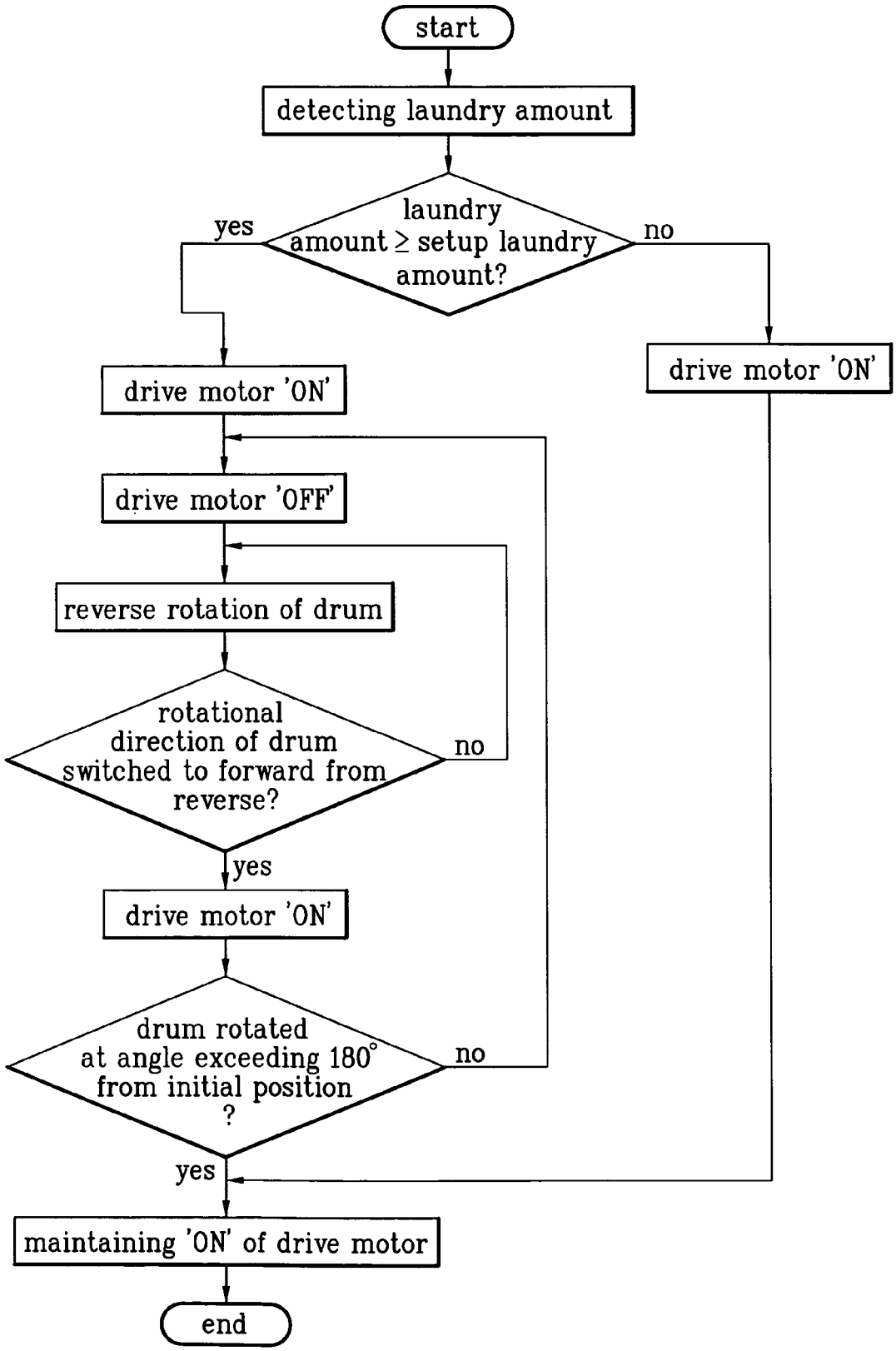
FIG. 3 is a flowchart of a method of controlling a washing course in a washing machine according to a first embodiment of the present invention.
Figure 4A:
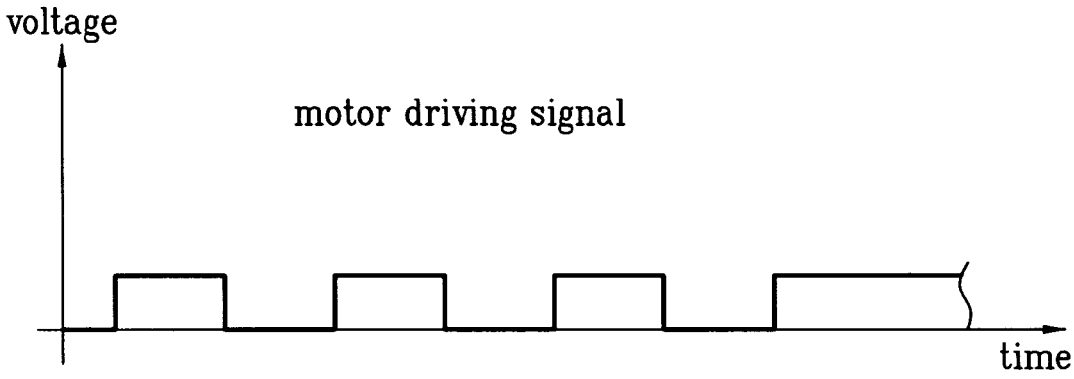
FIG. 4A is a timing diagram of a drive signal applied to a motor for an initial drive of the motor.
Figure 4B:
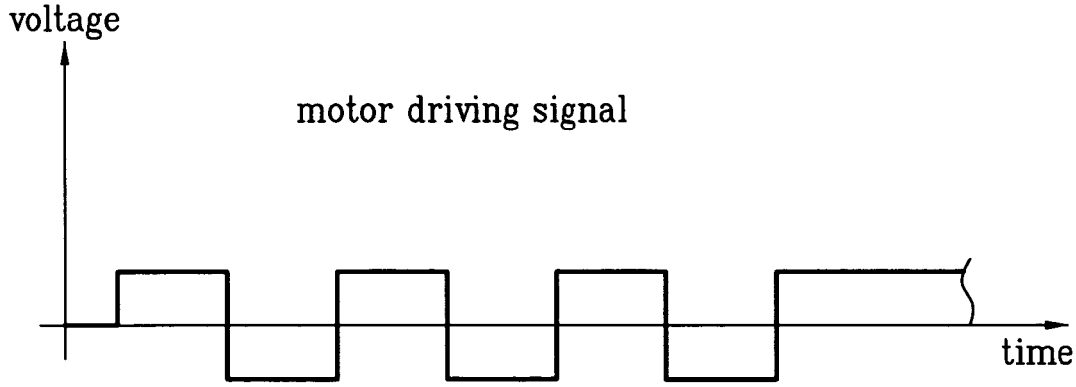
FIG. 4B is a timing diagram of another drive signal applied to a motor for an initial drive of the motor.
Figure 5A:
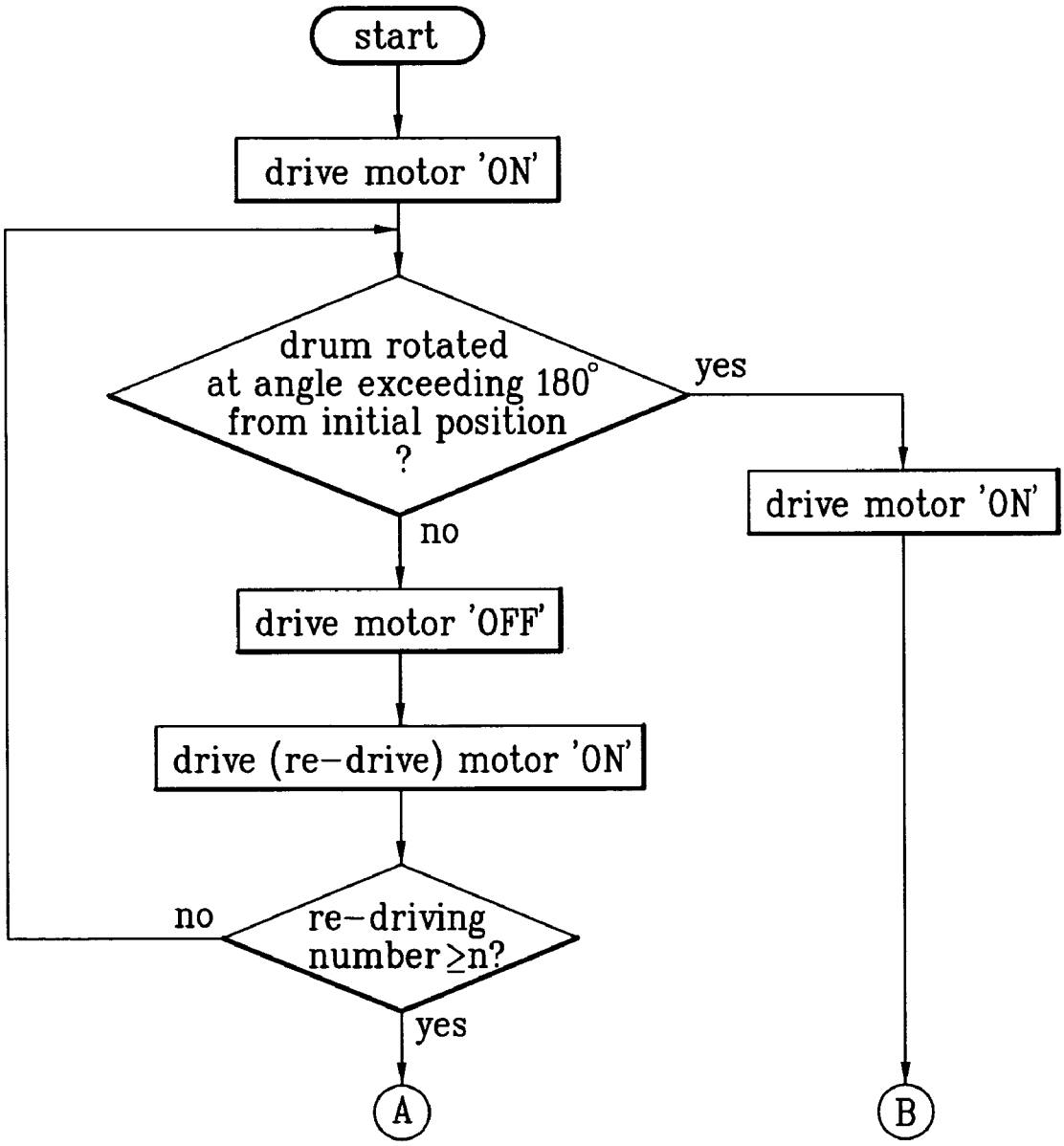
FIGS. 5A and 5B are flowcharts illustrating a method of controlling a washing course in a washing machine according to a second embodiment of the present invention.
Figure 5B:
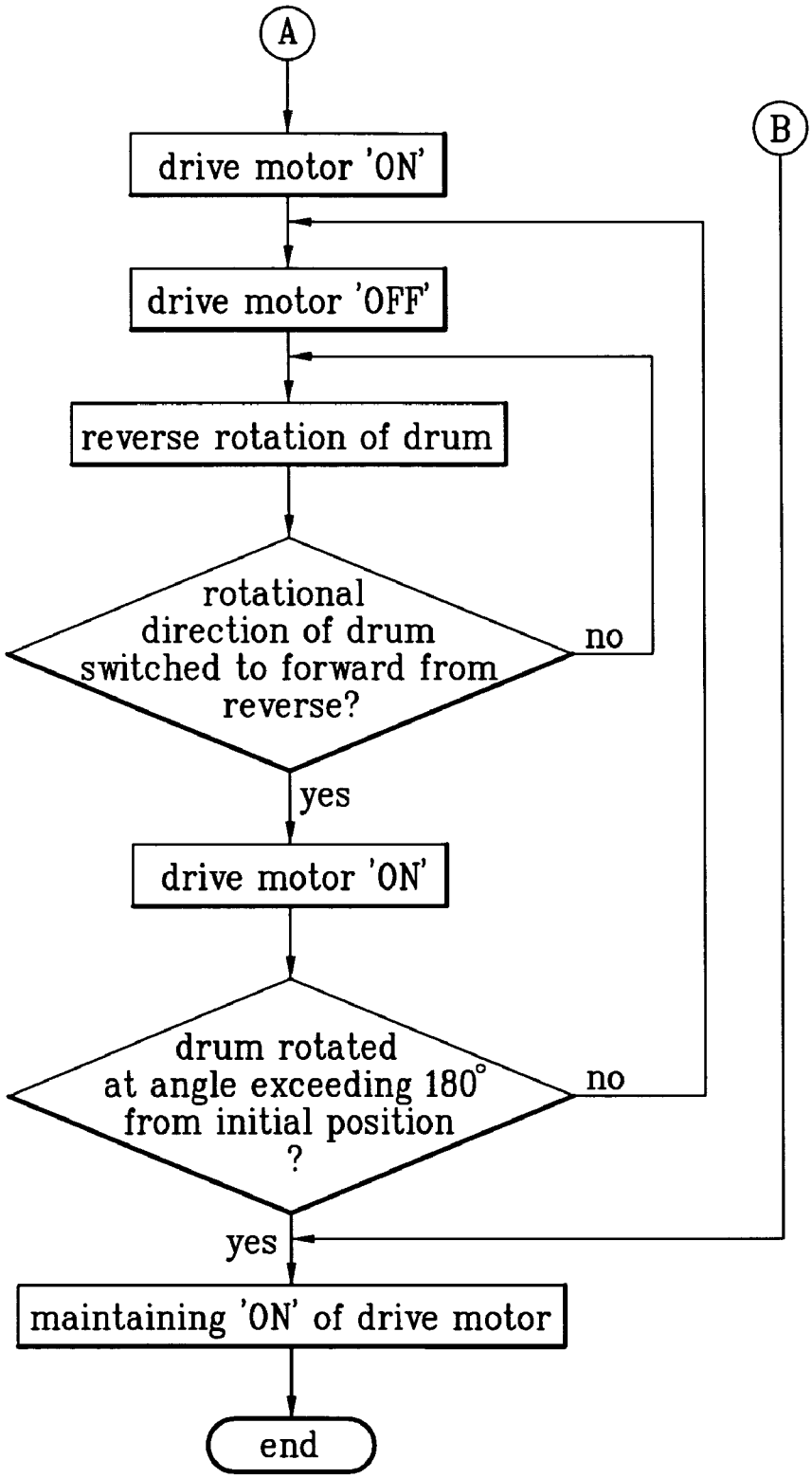

FIGS. 2A to 2C are diagrams for explaining a principle of a method of controlling a washing cycle in a washing machine according to the present invention, FIG. 3 is a flowchart of a method of controlling a washing course in a washing machine according to a first embodiment of the present invention, FIG. 4 is a timing diagram of a drive signal applied to a motor for an initial drive of the motor, and FIG. 5 is a flowchart of a method of controlling a washing course in a washing machine according to a second embodiment of the present invention.

Figure 1:
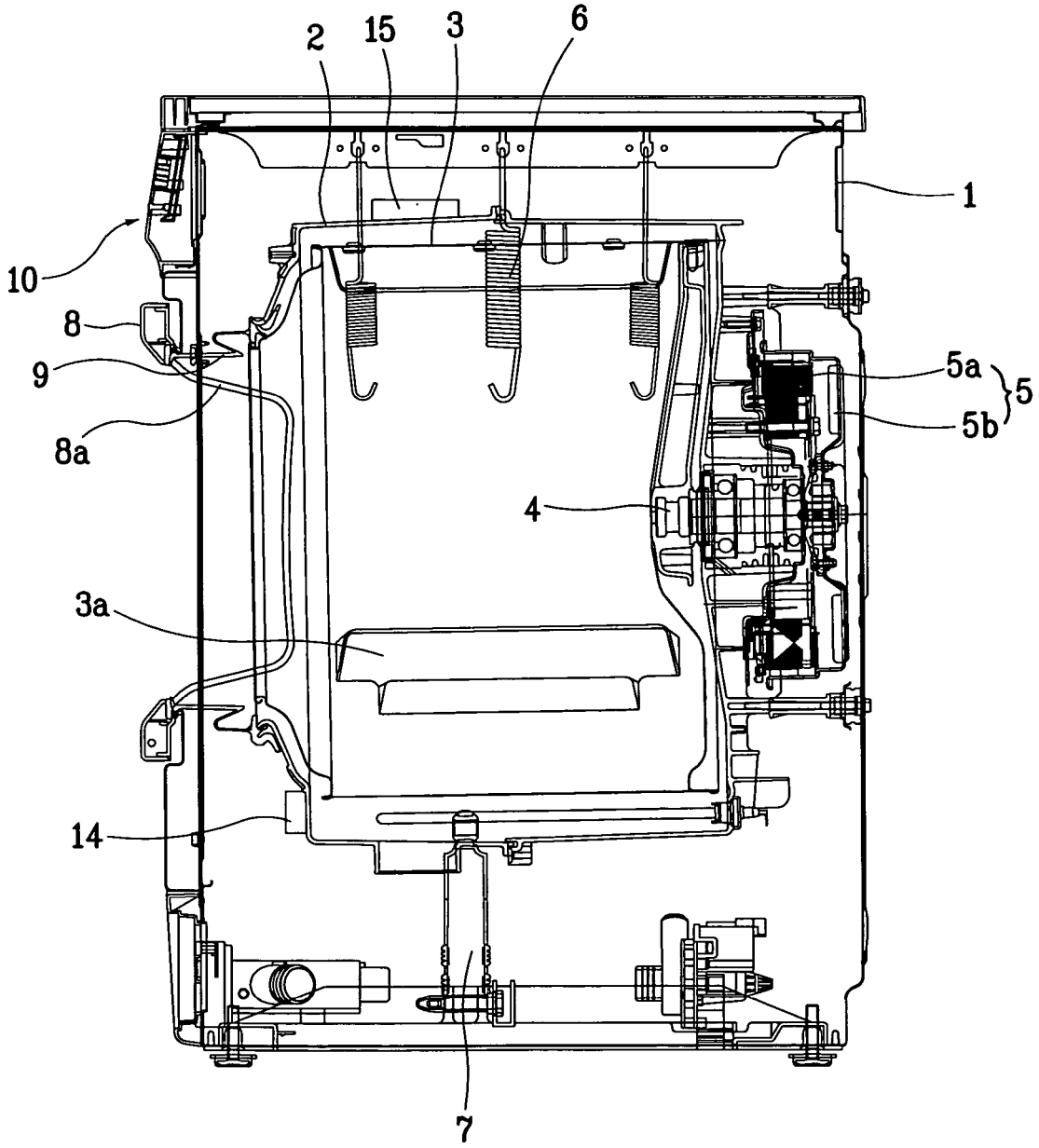
FIG. 1 Background Art
FIG. 1 is a cross-sectional diagram of a drum type washing machine according to a related art.

In the following description of the present invention, the configuration of the general drum type washing machine in FIG. 1 is consulted.

A drum type washing machine, as shown in FIG. 1, includes a tub 2, a drum 3 installed within the tub 2 to rotate centering around a horizontal axis, a motor 5 rotating the drum 3 in a first (forward) direction, an inlet/outlet unit (not shown in the drawing) supplying/draining water to/from the tub 2, and a control unit (not shown in the drawing) controlling an operation of the inlet/outlet unit. The control unit executes an initial operation sub-routine for the motor 5 if deciding that a laundry amount within the drum 3 exceeds a prescribed value.

In doing so, the initial operation sub-routine for the motor 5, as shown in FIGS. 2A to 2C, includes a first step of driving the motor 5 to rotate the drum 3 at a first angle (preferably about 70°) in the first direction, a second step of stopping driving the motor 5 so that the drum 5 is rotated in a second (reverse) direction opposite to the first (forward) direction by a gravitational force of a laundry within the drum 3, and a third step of driving the motor 5 again to rotate the drum 3 in the first (forward) direction while the drum 3 is rotated again in the first direction from the second direction by the gravitational force of the laundry.

The first step of initial drive sub-routine can be replaced by the following procedure. First of all, if deciding the measured laundry amount is greater than a prescribed laundry amount inputted according to user's presumption, the control unit drives the motor 5 until the drum 3 fails to be further rotated and then stops driving the motor 5 for the rotation generated by the gravitational force of the laundry in the second direction. In doing so, the drum 3 will be rotated at a predetermined angle not exceeding 180° in the first (forward) direction. And, the second and third steps follow the first step.

First Embodiment

FIG. 3 is a flowchart of a method of controlling a washing course in a washing machine according to a first embodiment of the present invention.

Referring to FIG. 3, a user puts a laundry in the drum 3 and then inputs a presumptive laundry amount of the laundry to the control panel 10. In doing so, the control unit (not shown in the drawing) enables to recognize the presumptive laundry amount. Once a washing cycle of the drum type washing machine is executed, a prescribed amount of water is supplied to the tub 2 and the motor 5 then starts to be driven.

In doing so, the control unit (not shown in the drawing) measures a real laundry amount of the laundry via weight sensor or the like. If the measured laundry amount is smaller than the inputted presumptive laundry amount, it means that a load put on the motor 5 is appropriate. Hence, the control unit normally controls a prescribed washing cycle to proceed in a manner of rotating the drum 3 in the first direction.

Yet, if deciding that the measured laundry amount is greater than the inputted presumptive laundry amount due to the excessively inputted laundry within the drum 3, the control unit turns on and off the motor 5 using a motor drive signal having a prescribed duty ratio, as shown in FIG. 4A, so that the drum 3 can perform at least one swing operation. And, FIG. 4A shows the motor drive signal according to the initial drive sub-routine for the motor 5.

In other words, if deciding that the measured laundry amount is greater than the inputted presumptive laundry amount, the control unit drives the motor 5 to rotate the drum 3 at a prescribed angle (about 70° in the first embodiment of the present invention) below 180° in the first (forward) direction. If the drum 3 is rotated at the prescribed angle, the control unit stops driving the motor 5. If so, the drum 3 starts to rotate in the second (reverse) direction by the gravitational force of the laundry.

Meanwhile, the first step of the initial drive sub-routine can be replaced by the following procedure. First of all, if deciding the measured laundry amount is greater than the prescribed laundry amount inputted according to user's presumption, the control unit drives the motor 5 until the drum 3 fails to be further rotated. In doing so, the drum 3 will be rotated at a predetermined angle not exceeding 180° in the first (forward) direction. If the drum 3 is unable to be further rotated after completion of the rotation at the predetermined angle, the motor 5 is stopped being driven.

Thereafter, if the second-directional rotation of the drum 3 is switched to the first-directional rotation by the gravitational force of the laundry, the control unit drives the motor 5 again to rotate the drum 3 in the first direction after a prescribed time has passed. In doing so, the drum 5 is rotated in the first direction by a rotational force greater than the previous one because of the drive force of the motor 5 and the gravitational force of the laundry. Hence, the drum 3 can be rotated at an angle greater than the initial rotational angle.

The drum 3 repeatedly performs the above-explained steps to swing in the first-to-second directions. In doing so, a predetermined amount of water is absorbed in the laundry within the drum 3 to reduce a volume of the laundry. Hence, the adhesion between the laundry and the door glass 8*a* is lowered. And, as the swing operations of the drum 3 are repeated, the rotational force of the drum 3 gradually grows.

Finally, if the swing operations of the drum 3 are repeated to provide a sufficient rotational force to the drum 3 at a specific time point, the drum 3 enables to rotate at an angle greater than 180° from an initial position. From the specific time point, the control unit stops executing the initial drive sub-routine for the motor no more and then executes the normal drive routine for the washing cycle. Therefore, the motor 5 keeps being driven according to the normal drive routine to rotate the drum 3 without being stopped for a predetermined time.

As mentioned in the foregoing description, the control unit preferentially measures the laundry amount of the laundry put in the drum 3. If the measure laundry amount exceeds the prescribed laundry amount, the control unit drives the motor 5 to execute the initial drive sub-routine for the motor.

Second Embodiment

In a second embodiment of the present invention, the control unit does not decide the laundry amount using the step of measuring the laundry amount of the laundry in the first embodiment of the present invention. Instead, the control unit decides the laundry amount in a different manner as follows.

FIG. 5 is a flowchart of a method of controlling a washing course in a washing machine according to a second embodiment of the present invention.

Referring to FIG. 5, if a laundry amount of the laundry put in the drum 3 is excessive, the drum 3 is unable to be normally rotated at an angle exceeding 180° on an initial drive of the motor 5. If the motor 5 is stopped by such an overload, the control unit stops driving the motor 5 for the moment. The control unit then drives the motor 5 again to rotate the drum 3 in the first direction right after the motor 5 has been stopped by the overload or after a prescribed time has passed. Such a procedure is repeated if the drum 3 keeps being unable to be rotated at the angle exceeding 180°. Meanwhile, the control unit counts the number of repeating the procedure. If the counted number exceeds a prescribed count 'n', the control unit decides that the laundry amount of the laundry exceeds a normal laundry amount. The control unit then executes the initial drive sub-routine for the motor 5.

Namely, the initial drive sub-routine is executed in a following manner. First of all, if deciding the measured laundry amount is greater than the prescribed laundry amount inputted according to user's presumption, the control unit executes a step of driving the motor 5 until the drum 3 fails to be further rotated. In doing so, the drum 3 will be rotated at a predetermined angle not exceeding 180° in the first (forward) direction. If the drum 3 is unable to be further rotated after completion of the rotation at the predetermined angle, the motor 5 is stopped being driven. Alternatively, the control unit can execute a step of stopping the drive of the motor 5 after having driven the motor 5 at a first setup angle (about 70° in the second embodiment of the present invention) in the first direction. If the motor 5 is stopped being driven after having been rotated to the predetermined angle not exceeding 180° or to the first setup angle according to the completion of one of the two steps, the drum 3 is rotated by the gravitational force of the laundry in the second (reverse) direction opposite to the first direction from the rotated position by the predetermined angle or the first angle in the first direction.

Thereafter, if the second-directional rotation of the drum 3 is switched to the first-directional rotation by the gravitational force of the laundry, the control unit drives the motor 5 again to rotate the drum 3 in the first direction after a prescribed time has passed. In doing so, the drum 5 is rotated in the first direction by a rotational force greater than the previous one because of the drive force of the motor 5 and the gravitational force of the laundry. Hence, the drum 3 can be rotated at an angle greater than the initial rotational angle.

The drum 3 repeatedly performs the above-explained steps to swing in the first-to-second directions. In doing so, a predetermined amount of water is absorbed in the laundry within the drum 3 to reduce a volume of the laundry. Hence, the adhesion between the laundry and the door glass 8*a* is lowered. And, as the swing operations of the drum 3 are repeated, the rotational force of the drum 3 gradually grows.

Finally, if the swing operations of the drum 3 are repeated to provide a sufficient rotational force to the drum 3 at a specific time point, the drum 3 enables to rotate at an angle exceeding 180° from an initial position. From the specific time point, the control unit stops executing the initial drive sub-routine for the motor no more and then executes the normal drive routine for the washing cycle. Therefore, the motor 5 keeps being driven according to the normal drive routine to rotate the drum 3 without being stopped for a predetermined time.

Meanwhile, to achieve the above-mentioned objects of the present invention, a third embodiment can be proposed. FIG. 4B is a timing diagram of another drive signal applied to a motor for an initial drive of the motor according to the third embodiment of the present invention.

In the third embodiment of the present invention, the motor 5 is driven until the drum 3 is unable to further be rotated in the first direction. The motor 5 is then driven in the second direction to rotate the drum 3 in the second direction opposite to the first direction by both of the gravitational force of the laundry within the drum 3 and the drive force of the motor 5 until the drum fails to be further rotated in the second direction. The above-explained steps repeatedly executed until the drum 3 is rotated in the first direction at an angle equal to or greater than 180°.

Subsequently, after a prescribed time has passed from a time point when a rotational direction of the drum 3 is switched to the second direction from the first direction, the motor 5 is driven to rotate the drum 3 in the second direction.

Meanwhile, a washing machine according to the third embodiment of the present invention includes a tub, a drum installed within the tub to be rotated centering around a horizontal axis, a motor rotating the drum in a first direction, an inlet/outlet unit supplying/draining water to/from the tub, and a control unit controlling an operation of the inlet/outlet unit. And, the control unit executes an initial operation sub-routine for the motor if deciding that a laundry amount of a laundry within the drum exceeds a prescribed laundry amount. In doing so, the initial operation sub-routine for the motor includes a first step of driving the motor until the drum is unable to further be rotated in the first direction, a second step of driving the motor in the second direction to rotate the drum in the second direction opposite to the first direction by both of the gravitational force of the laundry within the drum and the drive force of the motor until the drum fails to be further rotated in the second direction, and a third step of repeating the first and second steps until the drum is rotated in the first direction at an angle equal to or greater than 180°.

And, the initial operation sub-routine for the motor further includes the steps of measuring a laundry amount of the laundry put in the drum and if the measured laundry amount is small, driving the motor to rotate the drum in the first direction until the drum fails to be further rotated.

Moreover, the control unit enables to drive the motor in the second direction after a prescribed time has passed from a time point when a rotational direction of the drum is switched to the second direction from the first direction, Besides, the initial operation sub-routine for the motor further includes the steps of driving the motor to rotate the drum in the first direction until the drum fails to be further rotated, stopping driving the motor if the drum is rotated at an angle smaller than 180° in the first direction, re-driving the motor after an elapse of a prescribed time to rotate the drum in the first direction again and counting a corresponding motor re-driving number, and if the counted corresponding motor re-driving number is equal to or greater than a setup number, executing the above-explained steps.

As mentioned in the foregoing description, if the drum fails to be smoothly rotated because of the excessive amount of the laundry put in the drum, the control unit temporarily stops driving the motor. The control unit then performs the swing movement on the drum repeatedly by applying the rotational inertia force to the drum together with the drive force of the motor, thereby increasing the rotational force gradually.

Accordingly, the present invention enables to effectively wash the excessive amount of laundry despite insufficient drive power of the motor.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. In a washing machine having a motor for rotating a drum in a first direction, a method of controlling a washing course comprising the steps of:

driving the motor to rotate the drum to a prescribed rotational angle in the first direction;

stopping driving the motor so that the drum is rotated by a gravitational force of a laundry within the drum in a second direction opposite to the first direction; and rotating the drum in the first direction again by driving the motor in the first direction when the drum ceases rotation in the second direction and begins rotation in the first direction due to the gravitational force of the laundry, wherein the drum is rotated in the first direction by a rotational force greater than a previous one because of a drive force of the motor and the gravitational force of the laundry.

2. The method of claim 1, wherein the prescribed angle is smaller than 180°.

3. The method of claim 2, wherein the stopping and rotating are repeated until the drum is rotated to a rotational angle equal to or greater than 180°.

4. The method of claim 1, wherein the motor is driven after a prescribed time has passed measured from a point in time when the drum ceases rotation in the second direction and begins rotation in the first direction.

5. The method of claim 1, wherein the prescribed angle corresponds to an angle to which the drum is rotated by the driven motor until being unable to be further rotated.

6. The method of claim 1, wherein the prescribed angle is a previously set angle for rotating the drum using the motor.

7. In a washing machine having a motor for rotating a drum in a first direction, a method of controlling a washing course comprising the steps of:

measuring a laundry amount of a laundry put in the drum;

if the measured laundry amount exceeds a prescribed laundry amount:

driving the motor to rotate the drum to a prescribed rotational angle in the first direction;

stopping driving the motor so that the drum is rotated by a gravitational force of the laundry within the drum in a second direction opposite to the first direction; and rotating the drum in the first direction again by driving the motor in the first direction after the drum ceases rotation in the second direction and begins rotation in the first direction due to the gravitational force of the laundry, wherein the drum is rotated in the first direction by a rotational force greater than a previous one because of a drive force of the motor and the gravitational force of the laundry.

8. The method of claim 7, wherein the prescribed angle is smaller than 180°.

9. The method of claim 8, wherein the stopping and rotating are repeatedly executed until the drum is rotated to a rotational angle equal to or greater than 180°.

10. The method of claim 7, wherein the motor is driven after a prescribed time has passed measured from a point in time when the drum ceases rotation in the second direction and begins rotation in the first direction.

11. The method of claim 7, wherein the prescribed angle corresponds to an angle to which the drum is rotated by the driven motor until being unable to be further rotated.

12. The method of claim 7, wherein the prescribed angle is a previously set angle for rotating the drum using the motor.

13. In a washing machine having a motor for rotating a drum in a first direction, a method of controlling a washing course comprising the steps of:

driving the motor to rotate the drum to a prescribed rotational angle in the first direction;

stopping driving the motor when the drum is rotated at an angle smaller than a first angle;

re-driving the motor after an elapse of a prescribed time and counting a re-driving number of the motor;

if the counted re-driving number is equal to or greater than a prescribed number, driving the motor to rotate the drum at a second angle in the first direction;

stopping driving the motor so that the drum is rotated by a gravitational force of a laundry within the drum in a second direction opposite to the first direction; and rotating the drum in the first direction again by driving the motor in the first direction when the drum ceases rotation in the second direction and begins rotation in the first direction due to the gravitational force of the laundry, wherein the drum is rotated in the first direction by a rotational force greater than a previous one because of a drive force of the motor and the gravitational force of the laundry.

14. The method of claim 13, wherein the first angle is 180° and the second angle is smaller than 180°.

15. The method of claim 14, wherein the stopping and rotating are repeatedly executed until the drum is rotated to a rotational angle equal to or greater than 180°.

16. The method of claim 13, wherein the motor is driven after a prescribed time has passed measured from a point in time when the drum ceases rotation in the second direction and beams rotation in the first direction.

17. The method of claim 13, wherein the prescribed angle corresponds to an angle to which the drum is rotated by the driven motor until being unable to be further rotated.

18. The method of claim 13, wherein the prescribed angle is a previously set angle for rotating the drum using the motor.

19. In a washing machine having a motor for rotating a drum, a method of controlling a washing course comprising:

a first step of driving the motor until the drum is unable to further be rotated in a first direction;

a second step of driving the motor in a second direction opposite to the first direction to rotate the drum in the second direction using a gravitational force of a laundry within the drum and a drive force of the motor until the drum fails to be further rotated in the second direction; and a third step of repeating the first and second steps until the drum is rotated in the first direction to an angle equal to or greater than a prescribed rotational angle.

20. The method of claim 19, wherein the prescribed angle is 180°.

21. The method of claim 19, wherein the motor is driven after a prescribed time has passed measured from a point in time when the drum ceases rotation in the second direction and begins rotation in the first direction.

* * * * *